United States Patent [19]

Yamasaki et al.

[11] Patent Number: 5,002,732

[45] Date of Patent: Mar. 26, 1991

[54] COPPER ALLOY HAVING SATISFACTORY PRESSABILITY AND METHOD OF MANUFACTURING THE SAME

[75] Inventors: Shuichi Yamasaki, Omiya; Hiroshi Yamaguchi, Higashi-Murayama, both of Japan

[73] Assignee: Mitsui Mining & Smelting Co., Ltd., Tokyo, Japan

[21] Appl. No.: 400,444

[22] Filed: Aug. 30, 1989

[30] Foreign Application Priority Data

Sep. 20, 1988 [JP] Japan ..... 63-235670

[51] Int. Cl.[5] ..... C22C 9/06

[52] U.S. Cl. ..... 420/473; 148/412; 148/433; 148/11.5 C

[58] Field of Search ..... 420/473; 148/433, 412

[56] References Cited

U.S. PATENT DOCUMENTS 4,612,167 9/1986 Watanabe et al. ..... 420/473

4,732,731 3/1988 Asai et al. ..... 148/433

*Primary Examiner*—R. Dean

*Assistant Examiner*—Margery S. Phipps

*Attorney, Agent, or Firm*—Flynn, Thiel, Boutell & Tanis

[57] ABSTRACT

A copper alloy having satisfactory pressability and a method of manufacturing this alloy. The alloy contains: 0.1 to 0.4% (weight %) of Fe, 0.05 to 0.20% of Ti, 0.003 to 0.10% of Mg, 0.5 to 1.5% of Sn, and 0.01 to 1.0% of any one or two or all of the elements Zn, Ni and Co, the rest consisting of Cu except for impurities. The method comprises the steps of: hot-working this alloy; cold-working and annealing the hot-worked alloy one or more times, batch-annealing it at least once at 400° to 600° C. for 30 to 600 minutes and keeping the final cold-working ratio at 60% or less; and performing low-temperature annealing of the alloy at a temperature of 250° to 400° C.

10 Claims, 1 Drawing Sheet

COPPER ALLOY HAVING SATISFACTORY PRESSABILITY AND METHOD OF MANUFACTURING THE SAME

BACKGROUND OF THE INVENTION (a) Field of the Invention

This invention relates to a copper alloy suitable for making electrical and electronic parts whose physical properties are required to satisfy a wide range of requirements, be excellent in heat-resistance, electrical and thermal conductivity, mechanical strength, pressability, etc., as well as to a method of manufacturing this alloy.

(b) Description of the Prior Art

Conventionally, phosphor bronze has been used for such electrical and electronic parts. This material, however, may involve more heat generation than is desirable because of its low electrical conductivity. Furthermore, it is rather expensive. Brass, like phosphor bronze, may also be subject to more heat generation than is desirable due to its low electrical conductivity. Apart from this, hard tempered materials are not suited for electrical and electronic parts of the above category since they do no offer satisfactory pressability.

In view of this, various copper alloys have recently been proposed which excel both in electrical conductivity and mechanical strength. These alloys, however, are strengthened by precipitation hardening, so that, when subjected to pressing under severe conditions, they often suffer cracks For example, the alloy that the inventor of the present invention proposed in Japanese Patent Publication No. 62-39213 excels both in electrical conductivity and mechanical strength, but it may suffer cracks when formed into small terminals or the like by press working.

SUMMARY OF THE INVENTION

It is accordingly an object of this invention to provide a copper alloy for making electrical parts which excels both in electrical conductivity and mechanical strength and which provides satisfactory pressability.

Another object of this invention is to provide a method of manufacturing this copper alloy which excels in the various properties mentioned above.

In accordance with this invention, there is provided a copper alloy essentially containing: 0.1 to 0.4% (weight %) of Fe, 0.05 to 0.20% of Ti, 0.003 to 0.10% of Mg, 0.5 to 1.5% of Sn, and 0.01 to 1.0% of any one or two or all of the elements Zn, Ni and Co, the rest consisting of Cu except for impurities.

This invention also provides a method of manufacturing this alloy, comprising the steps of: melting and casting with the composition of the above-mentioned alloy; hot-working this alloy; annealing the hot-worked alloy one or more times, batch-annealing it at least once at 400° to 600° C. for 30 to 600 minutes and keeping the final cold-working ratio at 60% or less; and annealing the alloy at a low temperature of 250° to 400° C.

Thus, this invention helps to realize a copper alloy which excels in the various properties required of electric and electronic parts, such as heat conductivity, heat-resistance, strength, weldability, and pressability, as well as a method of manufacturing this alloy. The alloy will find a wide range of applications; it can be used for electrical and electronic parts such as connectors, terminals, lead materials, lead frames, switches and movable springs. It will greatly contribute to enhancing the performance of such parts as well as to miniaturizing and thinning them.

BRIEF DESCRIPTION OF THE DRAWING

FIG. 1(*b*) is a view similar to FIG. 1(*a*) and showing the specimen bent through an angle of about 90°.

DETAILED DESCRIPTION OF THE PREFERRED EMBODIMENTS

Figure 1A:
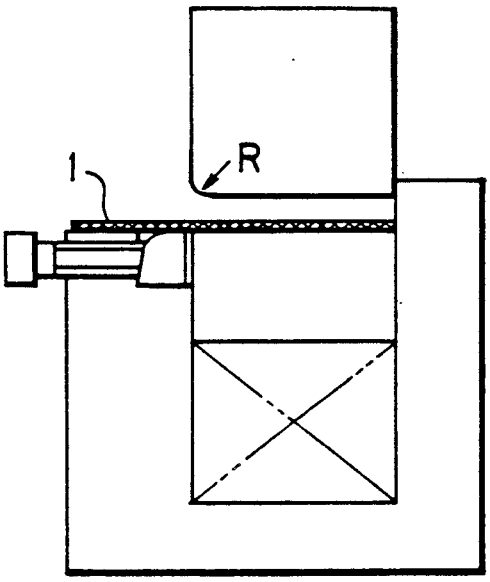
FIG. 1(*a*) shows a press die used for the purpose of judging the pressability of alloys in accordance with this invention, the press die being shown prior to bending the specimen.
Figure 1B:
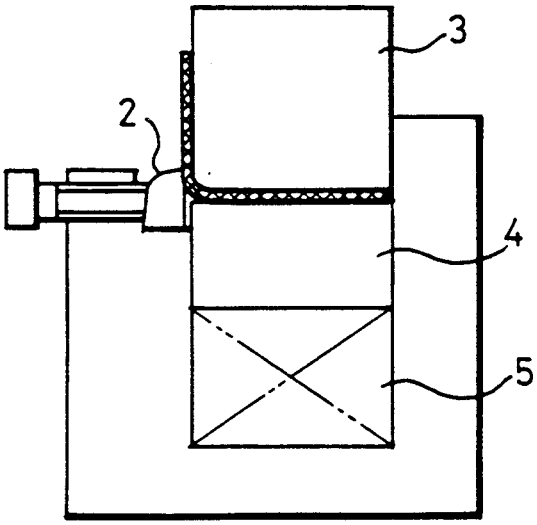

Embodiments of this invention will now be described in detail.

First, the reason for adopting some elements as components of the alloy of this invention will be explained as well as the reason for setting a limit to the range of these components.

Fe and Ti help, through a synergetic effect, to attain excellence in both mechanical strength and electrical conductivity, which constitutes an object of this invention. This is attributable to the fact that Fe and Ti generate the compound $Fe_2Ti$, which finely precipitates in the matrix in a traceable amount. In order to attain an excellent property by the precipitation of Fe and Ti, it is desirable that the elements exist in an appropriate proportion: Fe/Ti (the weight ratio) should be 1.4 to 2.8, more preferably 1.7 to 2.4. An excessive number of precipitating particles will result in the alloy being subject to cracks during pressing.

Thus, adding Fe together with a predetermined amount of Ti helps to increase the strength of the alloy of this invention and to maintain the high electrical conductivity thereof However, it should be noted that an Fe content of less than 0.1% will result in insufficient mechanical strength. Conversely, an Fe content in excess of 0.4% will result in deterioration of the pressability of the alloy. The preferable Fe content is from 0.15 to 0.30%.

The reason for making the Ti content 0.05% or more and 0.20% or less is that a Ti content of less than 0.05% results in insufficient strength even if Fe is added along with it, and that a Ti content of more than 0.20% results in deterioration in pressability. The preferable Ti content is from 0.08 to 0.15%.

Mg serves to improve the strength of the alloy. Furthermore, it acts as a strong deoxidizer, lowering the oxygen concentration in the alloy, thereby precluding problems such as plating blisters. With an Mg content of less than 0.003%, these effects will be insufficient; an Mg content of more than 0.10% will result in deterioration in melting workability for casting. The preferable Mg content is from 0.02 to 0.08%.

Sn increases the strength of the alloy. However, this effect will be insufficient if the Sn content is less than 0.5%. If it is in excess of 1.5%, the pressability of the alloy will deteriorate, the electrical conductivity thereof also deteriorating to an excessive degree. The preferable Sn content is from 0.8 to 1.4%.

Zn, Ni and Co are each capable of increasing the strength of the alloy. It is to be noted, however, that this effect is insufficient if the total amount of one or more elements selected from among Zn, Ni and Co is less than 0.01%. If, conversely, it is more than 1.0%, the electrical conductivity and the pressability of the alloy will deteriorate to an excessive degree. Apart from this, Zn works as a deoxidizer; when added prior to Mg during melting, it helps to realize preliminary deoxidization. It also helps to restrain the generation of hot-working cracks during hot-rolling. These effects cannot be obtained to a sufficient degree if the above-mentioned total amount is less than 0.01%.

Further, it is also possible to add 0.05 to 0.5% of Cr, Al, Zr, Sb, Mn, P, Ca, B, etc. to the alloy of this invention. This is effective in improving the strength of the alloy as well as deoxidizing the same.

Next, the method of manufacturing this alloy in accordance with this invention will be described. This method comprises the steps of: melting, casting and hot rolling in a conventional manner the above-mentioned alloy having the above composition; annealing and cold-working this alloy. One or more times, batch-annealing it at least once at 400° to 600° C. for 30 to 600 minutes and keeping the final cold-working ratio at 60% or less; and annealing the alloy at a low temperature of 250° to 400° C.

The reason for batch-annealing the alloy at least once instead of performing continuous annealing only is that batch-annealing causes the intermetallic compound consisting of $Fe_2Ti$ to precipitate, thereby increasing the heat-resistance, the strength and the electrical conductivity of the alloy. The reason for determining the annealing temperature to be 400° to 600° C. is that an annealing temperature of less than 400° C. will result in insufficient precipitation, and an annealing temperature of more than 600° C. will result in the precipitating particles of the $Fe_2Ti$ being excessively large, which renders insufficient the contribution thereof to improving the strength and the heat-resistance of the alloy The reason for limiting the annealing time to the range of 30 to 600 minutes is as follows: if the annealing time is less than 30 minutes, the $Fe_2Ti$ precipitation is insufficient; on the other hand, annealing the alloy for more than 600 minutes is of no use since the precipitation will be saturated within that period. The reason for keeping the final cold-working ratio at 60% or less is that if the ratio is more than 60%, the pressability of the alloy will be insufficient. The low-temperature annealing is conducted with a view to improving the elasticity and the pressability of the alloy; if the temperature is below 250° C., the pressability of the alloy will be insufficient, and, if it is above 400° C., the elasticity and strength thereof will deteriorate.

The preferable conditions are as follows: annealing temperature: from 480° to 580° C.; annealing time: from 300 to 500 minutes; final cold-working ratio: 55% or less; low-temperature annealing: at 250° to 350° C.

Examples of the alloy of this invention will now be described along with the method of manufacturing the same.

EXAMPLE 1

Ingots having various compositions in accordance with the examples of the alloy of this invention as well as the comparison examples which are shown in Table 1 were melted under charcoal cover in a high-frequency melting furnace and poured into metal molds. Each of the ingots obtained had a thickness of 35 mm, a width of 90 mm and a length of 150 mm. They were each scalped in each face until their thickness was 28 mm. Afterwards, they were hot-rolled with a starting temperature of 900° C. until their thickness was 12 mm. Then, they were scalped until their thickness was 10 mm and were cold-rolled to attain a thickness of 2.5 mm. Further, they were annealed at 500° C. for three hours, and were then cold-rolled to attain a thickness of 0.8 mm. Subsequently, they were subjected to annealing at 550° C. for three hours, and then underwent 50% cold working until their thickness was 0.4 mm. Finally, they were subjected to low-temperature annealing at 275° C. for one hour. The specimens obtained were measured for tensile strength, elongation and electrical conductivity as well as pressability. The measurement of the pressability was performed using the press-die shown in the accompanying drawing, wherein reference number 1 identifies the specimen, reference number 2 identifies a corner-forming member, reference number 3 identifies an upper pressing member, reference number 4 identifies a lower pressing member and reference number 5 identifies a spring. The specimens were subjected to 90° L-bending while changing the bend radius R, and examining the appearance of the bending sections with a magnifying lens. As the inner bend radius R is diminished, the narrow folds are deepened, eventually becoming cracks The value of R/t (R represents here the minimum bend radius R that does not cause the folds to be deepened; t represents the plate thickness) was used as the index for pressability. The results obtained are shown in Table 2.

TABLE 1

| Specimen | Composition (weight %) | | | | | |
|---|---|---|---|---|---|---|
| No. | Sn | Fe | Ti | Mg | others | Cu |
| Example 1 | 1.17 | 0.18 | 0.13 | 0.08 | Zn 0.30 | rest |
| Example 2 | 0.83 | 0.17 | 0.12 | 0.06 | Zn 0.13, Ni 0.25 | rest |
| Example 3 | 1.05 | 0.21 | 0.09 | 0.04 | Zn 0.10, Co 0.15 | rest |
| Example 4 | 1.10 | 0.16 | 0.11 | 0.09 | Zn 0.18 | rest |
| Comp. Ex. 5 | 2.10 | 0.16 | 0.08 | 0.07 | Zn 0.12 | rest |
| Comp. Ex. 6 | 0.90 | 0.61 | 0.28 | 0.06 | Zn 0.15 | rest |
| Comp. Ex. 7 | — | 0.22 | 0.10 | 0.06 | — | rest |
| Comp. Ex. 8 | 0.95 | 0.16 | 0.11 | 0.05 | — | rest |
| Phosphor bronze (H) | 6 | — | — | — | — | rest |
| Brass (EH) | — | — | — | — | Zn 35 | rest |

TABLE 2

| Specimen No. | Tensile Strength Kgf/mm$^2$ | Elongation % | Electrical Conductivity % IACS | Pressability min. R/t |
|---|---|---|---|---|
| 1 | 55 | 8 | 44 | 0.4 |
| 2 | 52 | 9 | 47 | 0.4 |
| 3 | 54 | 10 | 45 | 0.4 |
| 4 | 53 | 10 | 46 | 0.3 |
| 5 | 61 | 8 | 35 | 1.3 |
| 6 | 56 | 16 | 47 | 1.5 |
| 7 | 42 | 14 | 78 | 0.5 |
| 8 | 46 | 10 | 49 | 0.4 |
| Phosphor bronze | 63 | 16 | 16 | 0.0 |
| Brass | 53 | | 25 | 0.8 |

As will be appreciated from Table 2, Specimen 8, to which none of the elements Zn, Ni and Co is added, is defective in strength; when the amount of Sn (Specimen 5) or that of Fe and Ti (Specimen 6) is excessive, satisfactory pressability cannot be attained; and, when no Sn or Zn is added, the strength of the alloy is low (Specimen 7).

EXAMPLE 2

The alloy of Specimen 3 in Example 1 was prepared by different methods to examine the properties in the respective cases. Specimen 9 in Table 3 was prepared so that its thickness before the final cold-rolling was 1.2 mm, the cold-working ratio being kept at 67%. The low-temperature annealing of Specimen 10 was conducted at 180° C. for one hour, and that of Specimen 11 at 450° C. for one hour. The other manufacturing conditions for Specimens 9 to 11 were the same as those for Specimen 3. The results obtained are shown in Table 3.

TABLE 3

| Specimen No. | Conditions | Tensile Strength | Elongation | min. R/t |
|---|---|---|---|---|
| 9 | final rolling ratio 67% | 60 kgf/mm$^2$ | 8% | 0.8 |
| 10 | low-temp. annealing 180° C. | 56 kgf/mm$^2$ | 2 | 0.7 |
| 11 | low-temp. annealing 450° C. | 48 kgf/mm$^2$ | 15 | 0.3 |

As will be appreciated from Table 3, Comparison Examples 9 and 10, which were not prepared in accordance with the manufacturing method of this invention, exhibit poor pressability, whereas Specimen 11 has low strength.

What is claimed is:

1. A copper alloy which consists of 0.1 to 0.4 wt. % of Fe, 0.08 to 0.20 wt. % of Ti, 0.003 to 0.10 wt. % of Mg, more than 0.5 up to 1.5 wt. % of Sn, from 0.01 to 1.0 wt. % in total of one or more elements selected from the group consisting of Zn and Co, the remainder being Cu and inevitable impurities.

2. A copper alloy as claimed in claim 1, wherein the weight ratio of Fe/Ti is from 1.4 to 2.8.

3. A copper alloy as claimed in claim 1, wherein the weight ratio of Fe/Ti is from 1.7 to 2.4.

4. A copper alloy as claimed in claim 1, wherein the Fe content is from 0.15 to 0.30wt. %.

5. A copper alloy as claimed in claim 1, wherein the Ti content is from 0.08 to 0.15wt. %.

6. A copper alloy as claimed in claim 1, wherein the Mg content is from 0.02 to 0.08wt. %.

7. A copper alloy as claimed in claim 1, wherein the Sn content is from 0.8 to 1.4wt. %.

8. A copper alloy which consists of 0.1 to 0.4 wt. % of Fe, 0.05 to 0.20 wt. % of Ti, 0.003 to 0.10 wt. % of Mg, greater than 0.8 up to 1.5 wt. % of Sn, from 0.01 to 1.0 wt. % in total of one or more elements selected from the group consisting of Zn and Co, from 0.05 to 0.5 wt. % in total of one or more elements selected from the group consisting of Cr, Al, Zr, Sb, Mn, B, P and Ca, the remainder being Cu and inevitable impurities.

9. A copper alloy which consists of 0.15 to 0.30 wt. % o Fe, 0.08 to 0.15 wt. % of Ti, 0.02 to 0.08 wt. % of Mg, 0.8 to 1.4 wt. % of Sn, from 0.01 to 1.0 wt. % in total of one or more elements selected from the group consisting of Zn and Co, the remainder being Cu and inevitable impurities, the weight ratio of Fe/Ti being from 1.7 to 2.4, said alloy containing fine particles of $Fe_2Ti$.

10. A copper alloy which consists of 0.15 to 0.30 wt. % of Fe, 0.08 to 0.15 wt. % of T, 0.02 to 0.08 wt. % of Mg, 0.8 to 1.4 wt. % of Sn, from 0.01 to 1.0 wt. % in total of one or more elements selected from the group consisting of Zn and Co, from 0.05 to 0.5 wt. % in total of one or more elements selected from the group consisting of Cr, Al, Zr, Sb, Mn, B, P and Ca, the remainder being Cu and inevitable impurities, the weight ratio of Fe/Ti being from 1.7 to 2.4, said alloy containing fine particles of $Fe_2Ti$.

* * * * *

UNITED STATES PATENT AND TRADEMARK OFFICE

CERTIFICATE OF CORRECTION

PATENT NO. : 5 002 732

DATED : March 26, 1991

INVENTOR(S) : Shuichi YAMASAKI et al

It is certified that error appears in the above-identified patent and that said Letters Patent is hereby corrected as shown below:

On the title page, at Item [54] change the title to read as follows:
---COPPER ALLOY HAVING SATISFACTORY PRESSABILITY---.

On the title page, at Item [57] delete "The method...250° to 400°C."

Column 5, line 37; change "0.08" to ---0.05---.
line 38; change "0.5" to ---0.8---.

Signed and Sealed this

Sixteenth Day of March, 1993

*Attest:*

STEPHEN G. KUNIN

*Attesting Officer*

*Acting Commissioner of Patents and Trademarks*